US009102446B2

(12) United States Patent
Kowal et al.

(10) Patent No.: US 9,102,446 B2
(45) Date of Patent: Aug. 11, 2015

(54) TAMPER EVIDENT THERMOFORMED PLASTIC CLAMSHELL CONTAINER

(71) Applicant: LETICA CORP., Rochester, MI (US)

(72) Inventors: Eric Daniel Kowal, Macomb Township, MI (US); Randall Jon Corbett, Harrison Township, MI (US); John Robert Selina, Brighton, MI (US)

(73) Assignee: Letica Corporation, Rochester, MI (US)

( * ) Notice: Subject to any disclaimer, the term of this patent is extended or adjusted under 35 U.S.C. 154(b) by 83 days.

(21) Appl. No.: 14/015,045

(22) Filed: Aug. 30, 2013

(65) Prior Publication Data

US 2015/0060454 A1 Mar. 5, 2015

(51) Int. Cl.
*B65D 43/24* (2006.01)
*B65D 43/16* (2006.01)

(52) U.S. Cl.
CPC ..... *B65D 43/24* (2013.01); *B65D 43/169* (2013.01); *B65D 2101/0023* (2013.01); *B65D 2251/1008* (2013.01); *B65D 2543/00101* (2013.01); *B65D 2543/00296* (2013.01); *B65D 2543/00324* (2013.01); *B65D 2543/00509* (2013.01); *B65D 2543/00546* (2013.01); *B65D 2543/00842* (2013.01)

(58) Field of Classification Search
CPC ..... B65D 43/0241; B65D 43/0245; B65D 43/0539; B65D 43/0237; B65D 43/0235; B65D 43/02; B65D 43/162; B65D 43/161; B65D 43/164; B65D 43/163; B65D 43/16; B65D 43/14; B65D 43/166; B65D 43/24; B65D 2251/1008; B65D 2251/10; B65D 2251/1091
USPC ..... 220/4.23, 4.22, 4.21, 269, 270, 268, 220/266, 265, 260, 324, 315, 843, 836, 810, 220/832, 831, 283, 282, 281
See application file for complete search history.

(56) References Cited

U.S. PATENT DOCUMENTS

| | | | | |
|---|---|---|---|---|
| 4,986,438 | A * | 1/1991 | Borst | 220/315 |
| 5,269,430 | A * | 12/1993 | Schlaupitz et al. | 220/4.23 |
| 5,366,104 | A * | 11/1994 | Armstrong | 220/832 |
| 5,897,011 | A * | 4/1999 | Brilliant et al. | 220/4.23 |
| 7,992,743 | B2 * | 8/2011 | Vovan | 220/791 |
| 2012/0005994 | A1 * | 1/2012 | Tidball et al. | 53/484 |

* cited by examiner

*Primary Examiner* — Robert J Hicks
(74) *Attorney, Agent, or Firm* — Young Basile Hanlon & Macfarlane P.C.

(57) ABSTRACT

A clam shell plastic container includes a rectangular container body with a floor and tapered sides and an integral lid. The container body and lid are thermoformed in one piece and in an open configuration. A first hinge along the side of the container body between the container body and the lid allows the lid to rotate into a closed position on the container body. A tear strip adjacent the first hinge allows a user to separate the lid from the container body to open the container body. After separation the lid is relocked to the container body along the side opposite the first hinge and a second hinge along this opposite side is used thereafter to open the container.

10 Claims, 5 Drawing Sheets

TAMPER EVIDENT THERMOFORMED PLASTIC CLAMSHELL CONTAINER

FIELD OF THE INVENTION

The invention relates to molded plastic containers and more particularly to a clamshell-style container comprising a container body with a hingedly attached lid which can be maneuvered to seal the container. Thereafter, the lid can be opened to access the contents of the container by removing the primary hinge and actuating a secondary hinge.

BACKGROUND OF THE INVENTION

Clamshell-style plastic containers for food products such as food are well known. Such containers are often thermoformed from a plastic such as PET. The plastic may be opaque or clear so as to allow contents to be seen through the lid. A common feature of such containers is the use of a frangible corner section or a tear strip which must be removed in order to provide access to the contents of the container and to provide a "tamper evident" feature which yields physical evidence if the container has been opened prior to reaching the end user. A common problem with such containers is the fact that the corner piece or tear strip is a separate waste item that must be carefully disposed of in order that it may be kept out of the reach of children. Another problem with such containers is the fact that, once the tamper evident feature has been exercised, the lid is thereafter separate from the container.

SUMMARY OF THE INVENTION

This document discloses a clamshell-type molded plastic container for food service and/or other uses which has the advantages of (1) providing a tamper evident feature without producing a separate waste piece, and (2) maintaining a hinged connection between the lid and the container body after the tamper evident feature has been exercised.

In general, these advantages are achieved by molding, such as by thermoforming, an open top container body and a lid for closing the container body as a single piece with the lid integrally joined to the container by means of a primary hinge which is fracturable. The container body and lid further provide a lock on the side of the container body opposite the primary hinge which lock can be activated to close the container after the container has been filled. The lock may, for example, be of a dovetail or tongue-and-groove type. The lock, like the primary hinge, lies on a flange outside of a seal groove. The flange is perforated or otherwise formed to define a secondary hinge which can be used to open the container after the primary hinge has been fractured.

Thus, the lid can hinge along one side of the container in order to allow filling, and along the opposite side after the primary hinge has been fractured to gain access to the container contents.

Several additional features are also described herein. By way of example, detent means are provided along a tongue-and-groove lock which detent means is cooperative with a flange on the lid to hold the lid in a substantially fully open position during the time the end user wishes to have access to the contents of the container. A seal remains operative both before and after fracture of the primary hinge and allows the container to be effectively sealed after access to contents.

In accordance with the invention, the exercise of the tamper evident feature generates no separate waste item and the lid remains fully connected to the container at all times, both before and after exercise of the tamper evident feature of the container.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
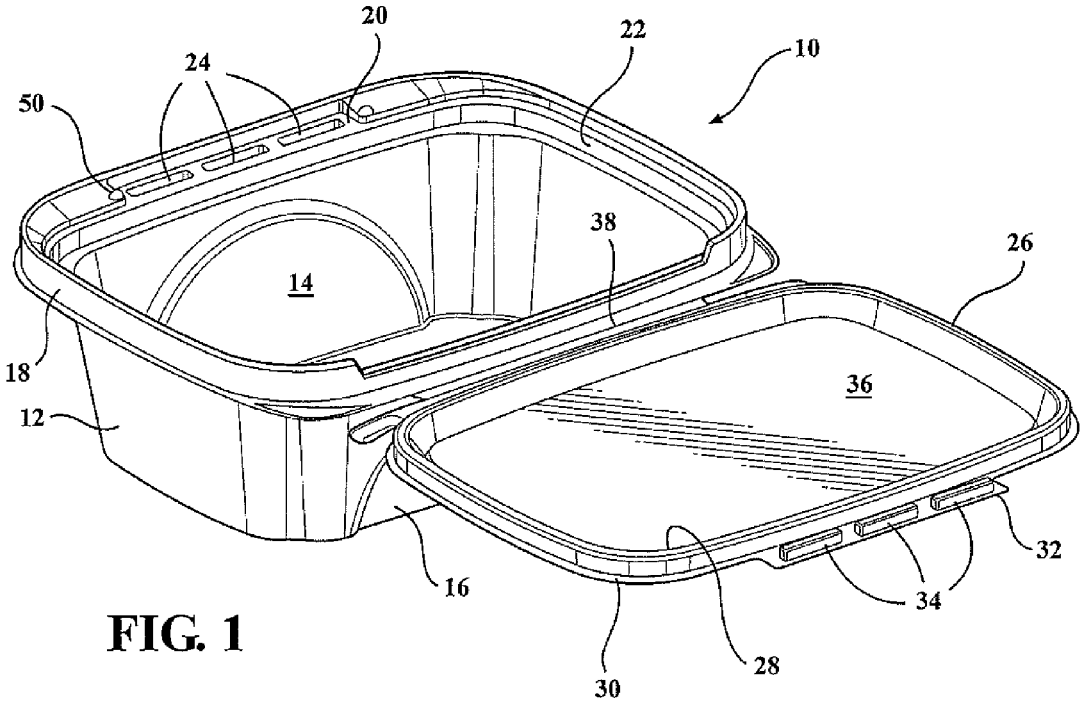
FIG. 1 is a perspective view of a thermoformed container showing the lid open and attached to the container body by a primary hinge.
Figure 2:
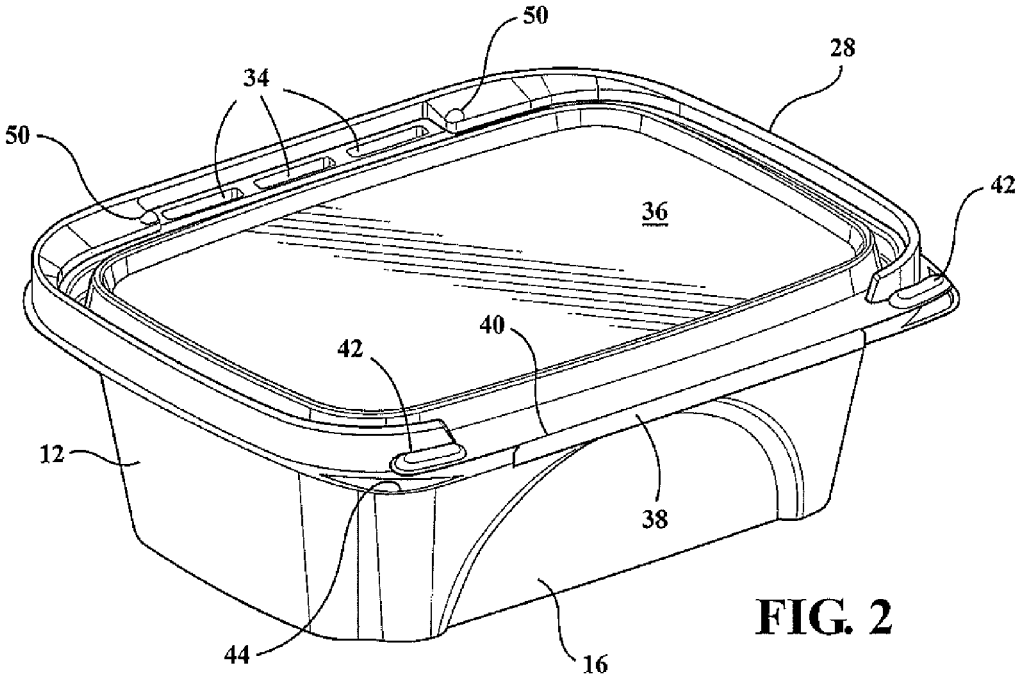
FIG. 2 is a perspective view of the container of FIG. 1 in a closed condition.

Referring to the figures, there is shown a molded plastic container 10, in this case thermoformed of PET, comprising a generally rectangular container body 12 having a floor and tapered sidewalls with beveled corners. The front and rear walls have half-moon shaped recessed areas 14, 16 to add stiffness. Surrounding the open top of the container body 12 is an inverted U-shaped peripheral rim 18 defining a ledge 20 adjacent a vertical seal surface 22 fully surrounding the container body 12. Formed within the ledge 20 are three co-linear but separate grooves 24, rectangular in shape and with closed bottoms for purposes to be described.

In addition to the container body 12, the thermoformed container 10 further comprises a hingedly attached lid 26 having a U-shaped peripheral seal flange 28 which, when the lid 26 is closed, has an outside surface which bears against the inside seal surface 22 of a the container body 12. A deck flange 30 surrounds the lid 26 and has an enlarged portion 32 containing three rectangular and co-linear tongue tabs 34 which, when the container lid 26 is fully closed, fit and lock into the rectangular grooves 24 as shown in FIGS. 2, 6, 7, 9, 10 and 11. The lid 26 has a flat top deck surface 36 and the bottom of the container 10 is configured so that filled containers can be conveniently and stably stacked on top of one another for storage and/or display at a point of purchase.

When molded, the container 10 comprising the container body 12 and the lid 26 is made as a single unitary piece in which the lid 26 is joined to the container body 12 by means of a primary hinge 38 which lies outside of the seal 22, 28. The primary hinge, however, can be manually fractured along a perforated tear line 40 with the assistance of tear tabs 42 along the outside edges of the lid hinge and hold-down tabs 44 on the outside rear edges of the container body 12. No tools are required to fracture the hinge.

Figure 3:
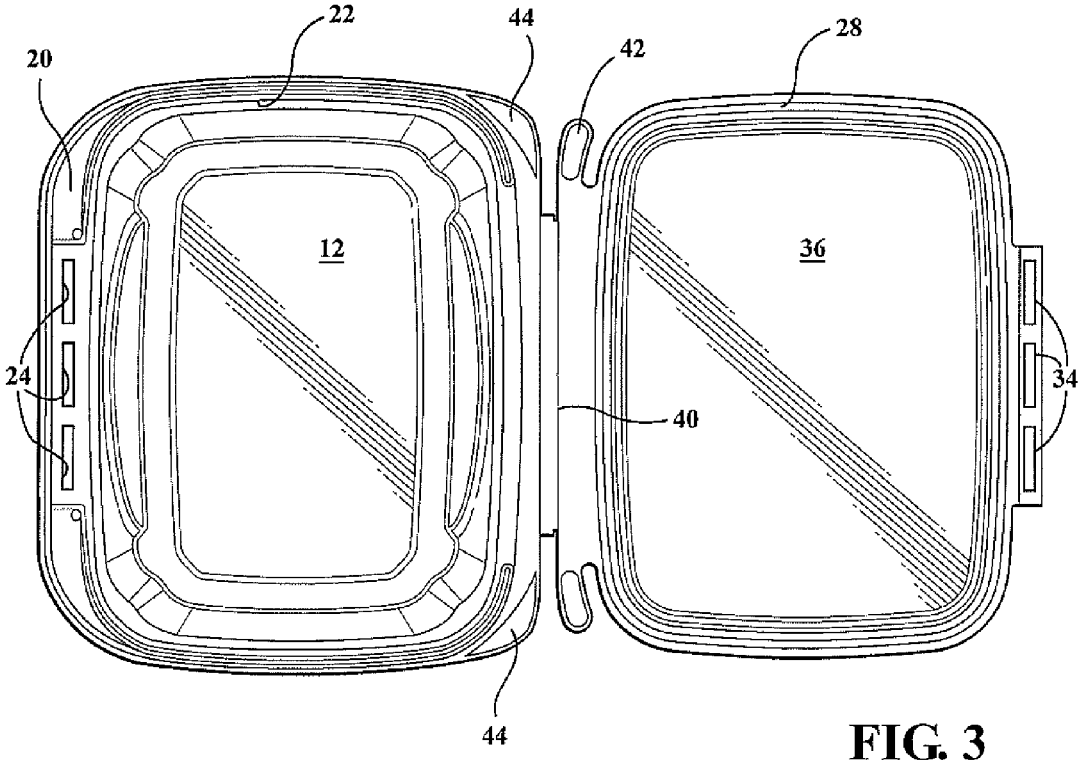
FIG. 3 is a top plan view of the container of FIG. 1 in an open condition.
Figure 4:
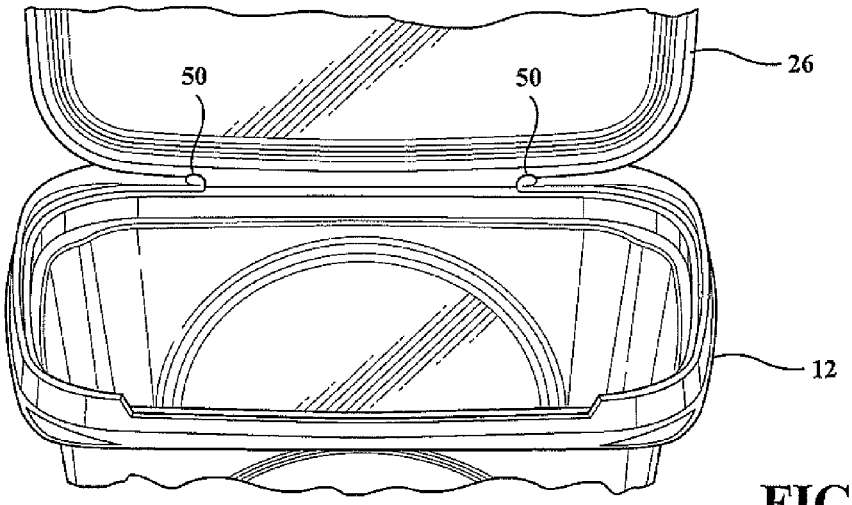
FIG. 4 is a perspective view of the container open after fracture of the primary hinge.

In use, the container 10 is molded as shown in a single piece with a container body 12 and lid 26 hingedly attached, but fully open so that containers 10 may be nested together in substantial numbers for shipment and storage. The containers are filled with the lid 26 in the open condition as shown in FIGS. 1 and 3. Thereafter, the lid 26 is closed by rotation of the hinge 38 and insertion of the tongue tabs 34 into the grooves 24 so as to lock the lid in place with the seal 22, 28 fully intact and operative.

Figure 5:
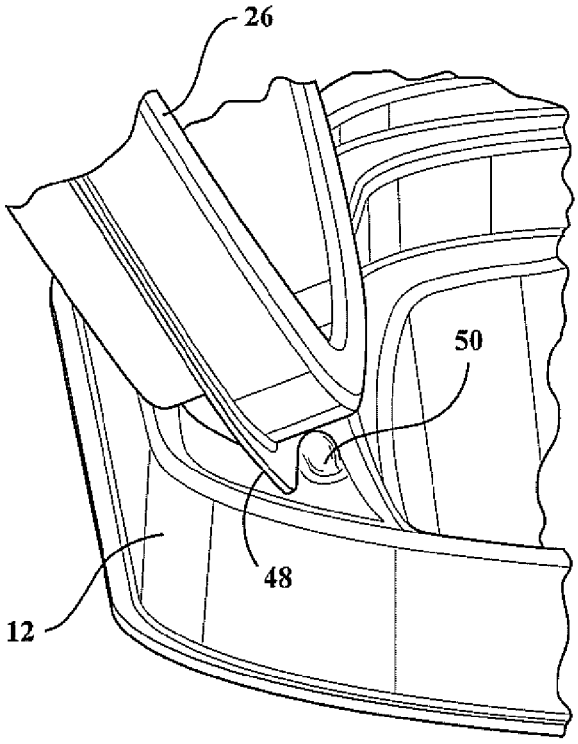
FIG. 5 is a partial perspective view of the container opened along a secondary hinge and held open by a detent.
Figure 6:
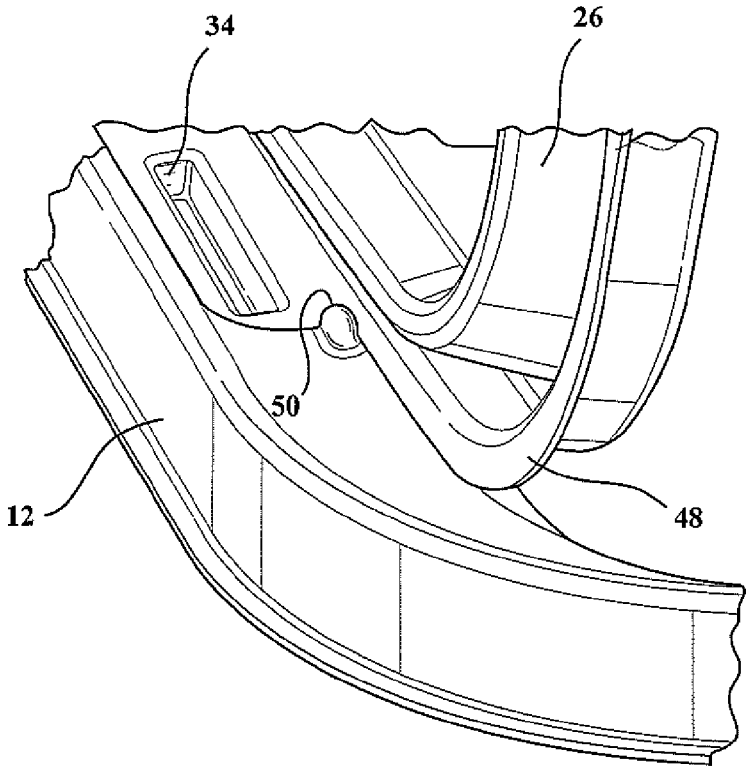
FIG. 6 is a partial perspective view showing the detent and part of a lock structure.
Figure 7:
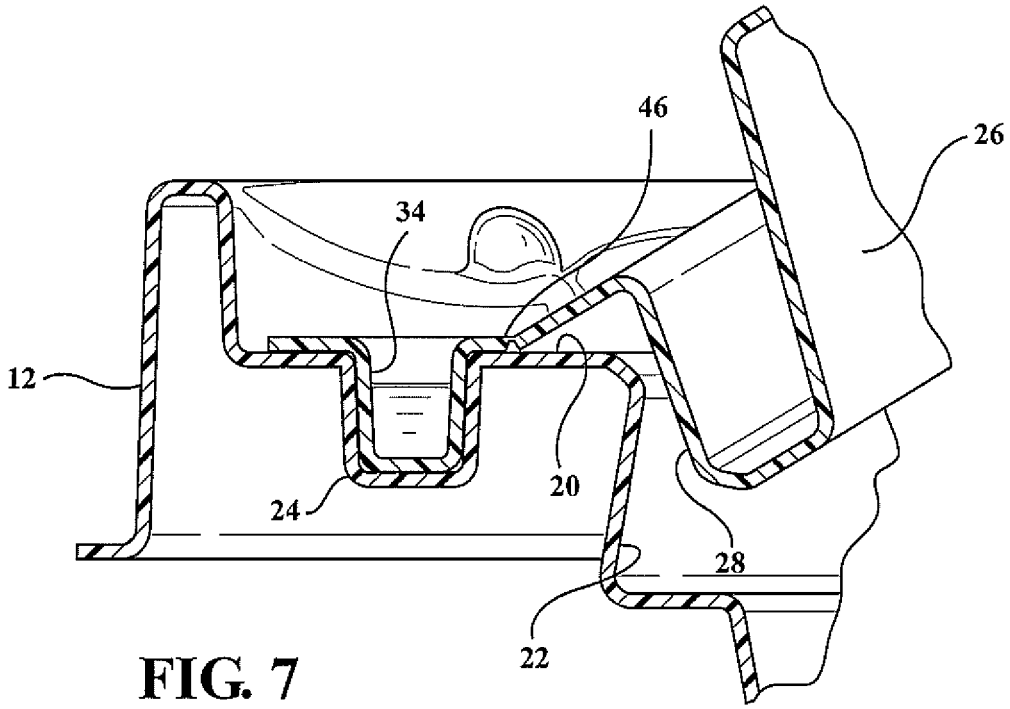
FIG. 7 is a sectional view through a secondary lock with the lid partially open.
Figure 10:
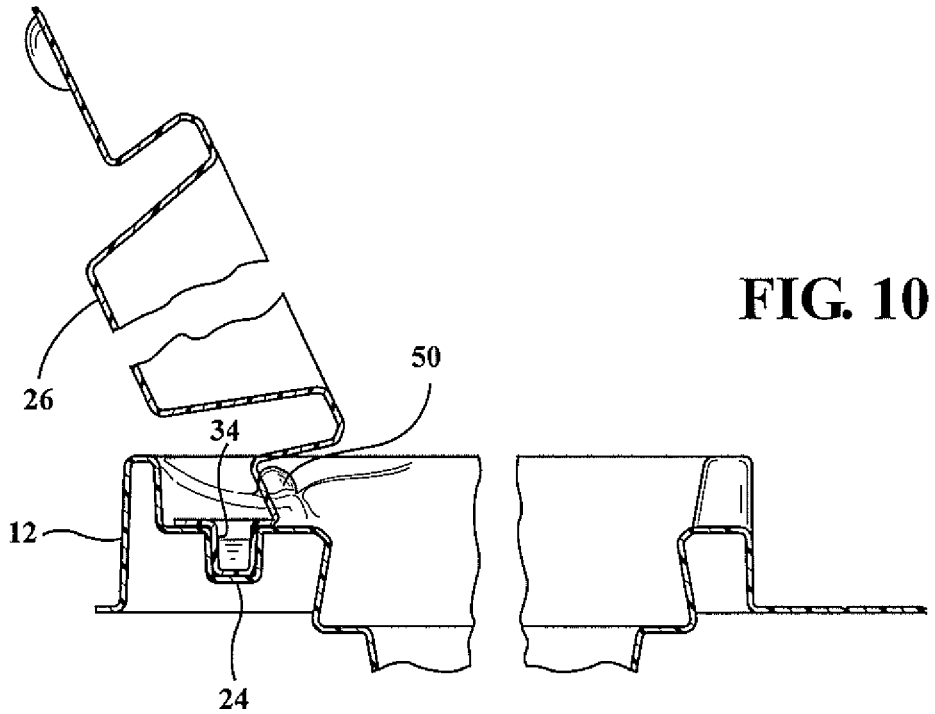
FIG. 10 is another sectional view showing the lid opened and held in place by a detent.
Figure 8:
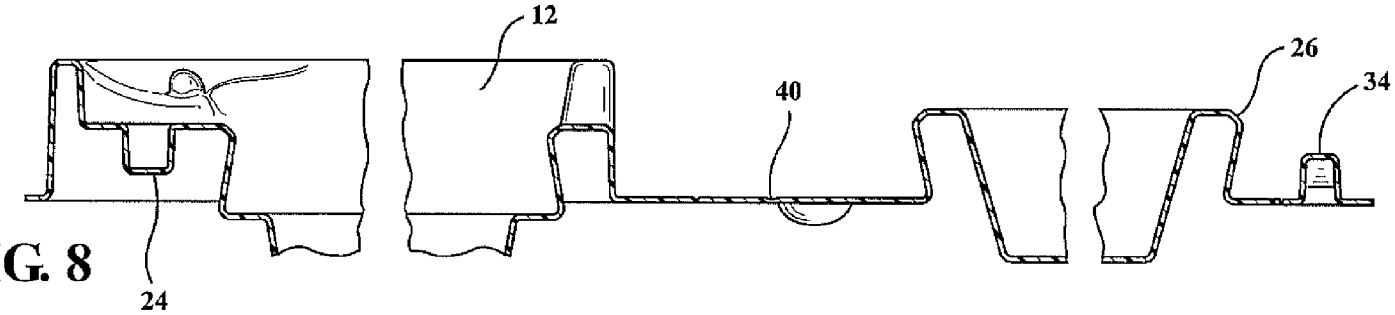
FIG. 8 is another sectional view showing the container and lid open.
Figure 9:
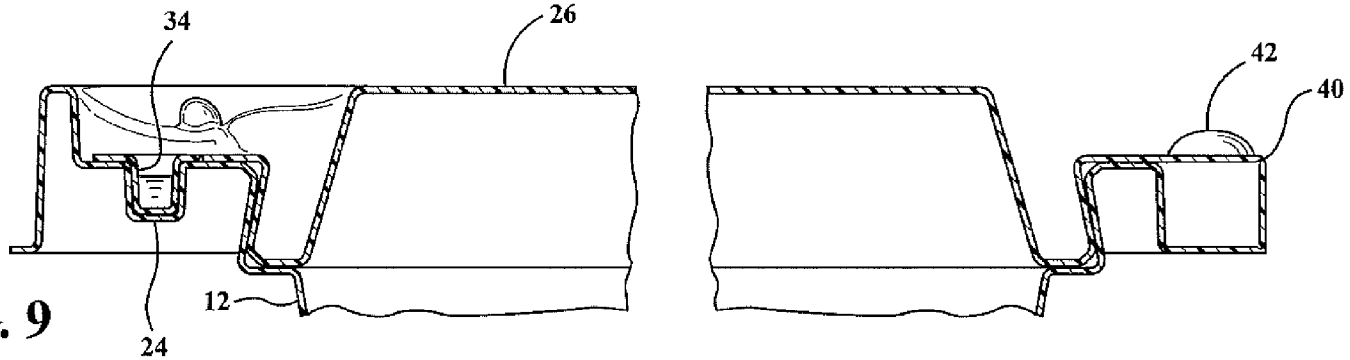
FIG. 9 is a sectional view showing the container and lid closed and locked.
Figure 11:
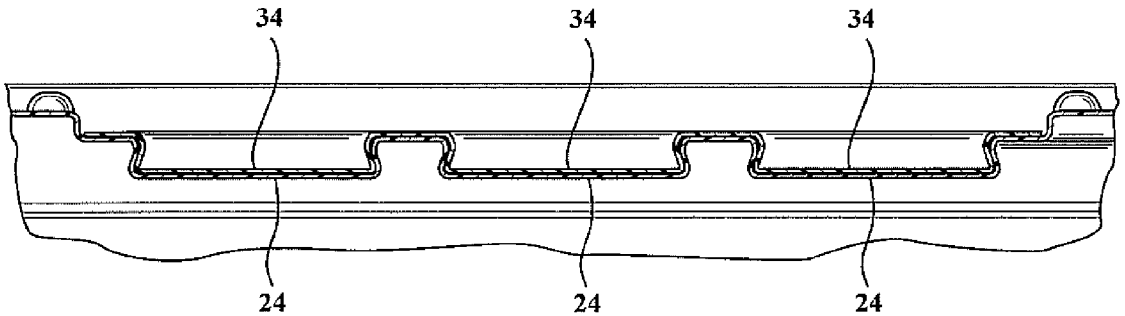
FIG. 11 is a sectional view through the secondary dovetail or tongue-and-groove lock.

The end user, of course, wishes to gain access of the container 10. To accomplish this, the end user uses the tabs 42, 44 to fracture the perforated line 40 thereby terminating the efficacy and operability of the primary hinge 38 and physically separating what was formerly the rear edge of the lid 26 from the container body 12 sufficiently to allow the lid 26 to be lifted up and away from the container body 12 as shown in FIG. 7. This maneuver brings into play a secondary hinge 46 which is formed outside of the seal surfaces 22, 28 (as shown in FIG. 7) but inside of the tongue-and-groove locking arrangement 24, 34. The lid 26 can therefore be rotated around the secondary hinge 46 until it reaches the condition shown in FIGS. 4, 5, 6 and 10 until an edge flange 48 on the lid 26 engages raised detent buttons 50 formed on the container ledge 20 immediately outside of the groove portions 24 as shown in FIG. 6. Buttons 50 are hollow and, therefore, fairly resilient. If the operator/user continues to rotate the lid 26 toward a fully open condition, the flange 48 passes over the resilient detent buttons 50 until it is parked behind the detent buttons 50 as shown in FIG. 5, thus holding the lid 26 in the fully open condition for convenient access to the container. This fully open condition is also shown in FIG. 10. In this condition, the tongue-and-groove locks 24, 34 secure the lid 26 to the container body 12 in such a fashion that the container remains effectively in a unitary or one-piece condition, the hinge function having been transferred from the primary hinge on one side of the container to the secondary hinge on the opposite side of the container as described above. The perforation of the primary hinge along the line 40 creates no waste piece and the container body 12 and lid 26 remain securely attached to one another. Finally, the lid remains fully resealable to the container body 12 simply by rotating the lid back over the detent buttons 50 and continuing the rotation around the secondary hinge until the lid 26 is once again sealed to the container body 12.

For commercial purposes, the PET material may be clear so that the end user may view the contents of the container 10. However, opaque plastics of various types can be used for this device. In addition, while thermoforming is believed at this time to be the preferred method of manufacture, other plastic molding technologies, including injection molding, can also be employed. The thickness of the PET is such that the entire container 10, except for the stiffening features provided by the contours shown and described, is reasonably resilient and lightweight and this resiliency is of a significant value in performing the locking function between the tabs 34 and the grooves 24 as well as the hinging function and the detent latching function, all as described immediately above.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A molded plastic container structure comprising:

an open container having a floor, continuous sidewalls integral with said floor, a peripheral flange around an open top and, within said flange, a continuous peripheral seal groove;

a lid having a central deck configured to cover said open container top and a peripheral seal plug complemental to said container seal groove;

a frangible tear strip integrally attaching the lid to the container along a first side when in the originally molded condition adjacent and parallel to a primary hinge that allows the lid to uncover said container while remaining attached to said container; said tear strip being fracturable to free the lid from said container along said first side;

tongue in groove locking structure formed on a second side of the lid and container opposite said first side to lock the lid to the container along said second side outside of said seal groove; and a secondary hinge formed between said locking structure and said seal groove to allow said lid to open said container by hinging along said secondary hinge after said tear strip is fractured.

2. A molded plastic container as defined in claim 1 wherein the lid and container are integrally thermoformed.

3. A molded plastic container as defined in claim 2 wherein the container and lid are formed of PET.

4. A molded plastic container as defined in claim 1 wherein the frangible tear strip has at least a pair of opposite end tabs to facilitate fracturing of said tear strip.

5. A molded plastic container as defined in claim 1 further comprising detent means formed adjacent said secondary hinge and configured to interact with an edge flange of said lid to hold said lid in an open condition when rotated about said secondary hinge.

6. A molded plastic container as defined in claim 1 wherein the shape is the container is substantially rectangular.

7. An integral plastic container/lid combination with first and second opposite parallel sides, a peripheral plug fit between said lid and container for sealing and a deck flange for running peripherally around at least a portion of said container and outside of peripheral plug fit;

a first hinge on the first side of the container/lid combination;

a second hinge on the second side of said container/lid combination;

a tear line adjacent and parallel to said first hinge to separate the lid from the container along said first side to permit opening of said container by rotating lid around said second hinge.

8. An integral plastic container/lid combination as defined in claim 7 wherein said container and lid have formed therein adjacent and outside of said second hinge a tongue and groove lock to selectively close and lock the lid to the container after filling the container.

9. An integral plastic container/lid combination as defined in claim 8 further comprising detent means formed along said second hinge to hold the container in an open condition when said lid is rotated about said second hinge.

10. A plastic container comprising:

a container body having a floor and, integral with said floor, a continuous sidewall structure having first and second opposite sides;

a lid confirming to said container body;

said lid and said container body being molded as a single piece wherein said lid is attached to said container body by a first hinge extending along said first side;

a tear strip along said first side operable by a user to separate said lid from said container body;

a lock structure along said second side to reattach said lid to said container body; and said lock structure including a second hinge operable to open the container body by rotation of said lid while said lid remains reattached to said container body.

* * * * *